US009428879B2

(12) United States Patent
Gancel et al.

(10) Patent No.: US 9,428,879 B2
(45) Date of Patent: Aug. 30, 2016

(54) METHOD FOR MANUFACTURING A RETAINING WALL FROM A ROUGH SOIL-MIX WALL

(75) Inventors: Philippe Gancel, Rueil-Malmaison (FR); Daniel Viargues, Rueil-Malmaison (FR); Matthieu Gueydier, Rueil-Malmaison (FR); Fabrice Mathieu, Rueil-Malmaison (FR); Sabine Darson-Balleur, Rueil-Malmaison (FR)

(73) Assignee: SOLETANCHE FREYSSINET, Rueil-Malmaison (FR)

( * ) Notice: Subject to any disclaimer, the term of this patent is extended or adjusted under 35 U.S.C. 154(b) by 27 days.

(21) Appl. No.: 14/123,101

(22) PCT Filed: May 25, 2012

(86) PCT No.: PCT/FR2012/051178

§ 371 (c)(1), (2), (4) Date: Mar. 25, 2014

(87) PCT Pub. No.: WO2012/168616

PCT Pub. Date: Dec. 13, 2012

(65) Prior Publication Data

US 2014/0219729 A1 Aug. 7, 2014

(30) Foreign Application Priority Data

Jun. 1, 2011 (FR) ..... 11 54817

(51) Int. Cl.

*E02D 29/02* (2006.01)
*E02D 5/18* (2006.01)
*E02D 19/18* (2006.01)

(52) U.S. Cl.

CPC ..... *E02D 29/02* (2013.01); *E02D 5/18* (2013.01); *E02D 5/187* (2013.01); *E02D 19/18* (2013.01)

(58) Field of Classification Search

CPC ..... E02D 17/13; E02D 19/16; E02D 5/187; E02D 29/02; E04B 1/6806; E04B 1/0007; E04B 1/66

See application file for complete search history.

(56) References Cited

U.S. PATENT DOCUMENTS

| | | | | |
|---|---|---|---|---|
| 3,893,302 | A * | 7/1975 | Peterson | 405/267 |
| 4,467,587 | A | 8/1984 | Montagnan | |
| 4,909,674 | A * | 3/1990 | Konno et al. | 405/267 |
| 5,244,315 | A * | 9/1993 | Kitanaka et al. | 405/267 |

(Continued)

FOREIGN PATENT DOCUMENTS

| | | | |
|---|---|---|---|
| BE | 899304 | A1 | 7/1984 |
| DE | 3504161 | A1 | 8/1986 |

(Continued)

*Primary Examiner* — Tara M. Pinnock

(74) *Attorney, Agent, or Firm* — MH2 Technology Law Group, LLP

(57) ABSTRACT

Systems and methods for fabricating a retaining wall include an operation for making an untreated wall in the ground. This may be done by digging a trench in the ground and simultaneously mixing the ground in situ with a binder. Next may be a further operation for excavating a volume of ground adjacent to the untreated wall so as to uncover a surface of the untreated wall. Following that may be a further operation for treating the untreated wall during which a protective treatment substance comprising a polymer substance is applied to the surface that was uncovered in such a manner as to obtain a retaining wall of a thickness that is substantially equal to the thickness of the untreated wall.

16 Claims, 4 Drawing Sheets

(56) References Cited

U.S. PATENT DOCUMENTS

| | | | | |
|---|---|---|---|---|
| 5,349,765 | A * | 9/1994 | Kitanaka et al. | 37/356 |
| 5,820,303 | A | 10/1998 | Schneider | |
| 6,739,805 | B2 * | 5/2004 | Shotton | 405/267 |
| 8,079,163 | B2 * | 12/2011 | Shreider et al. | 37/462 |
| 2009/0165338 | A1 | 7/2009 | Chagnot | |
| 2010/0232881 | A1 * | 9/2010 | Carter, Jr. | 405/55 |

FOREIGN PATENT DOCUMENTS

| | | | | |
|---|---|---|---|---|
| DE | 4343851 | C1 | 6/1995 | |
| DE | 29823360 | U1 | 5/1999 | |
| FR | 2879632 | A1 | 6/2006 | |
| JP | 2001032235 | A | 2/2001 | |
| JP | 2006022493 | | 1/2006 | |
| WO | WO 2007116178 | A1 * | 10/2007 | E02D 5/18 |

* cited by examiner

METHOD FOR MANUFACTURING A RETAINING WALL FROM A ROUGH SOIL-MIX WALL

BACKGROUND OF THE INVENTION

The present invention relates to the field of fabricating retaining walls in the ground, and of retaining works made up of a plurality of retaining walls.

More particularly, the invention relates to a method of fabricating a retaining wall with the help of a technique of digging earth and mixing it up in situ with a binder (known as "soil-mixing"). In known manner, that technique consists in in situ mixing earth with a binder in order to constitute treated soil elements, presenting mechanical and/or geotechnical characteristics that are better than those of the natural non-treated earth. To do this, appropriate tooling is used, such as that described in document WO 2007/116178 or FR 2 879 632.

Such machines serve to make untreated walls in the ground, and more generally continuous structures of treated soil constituted by repeatedly passing the tooling in juxtaposed excavations.

It is also known to excavate a volume of ground adjacent to the untreated wall in order to uncover a surface of the untreated wall, after which said surface is in the open air.

The material that results from mixing the soil in situ with the binder presents the advantage of requiring less natural resources in order to be performed.

Nevertheless, since the resulting material is produced by mixing, it presents characteristics that are very different from those of concrete: the material is much less strong, it is very non-uniform, it presents micro pores, and it provides less protection than concrete for any reinforcement that might be embedded in the untreated wall.

A large difference between concrete and the material that results from the mixing (referred to as soil-mix) is its porosity. Whereas concrete has porosity lying in the range 5% to 15% by volume, a soil-mix material presents porosity lying in the range 30% to 65%. It is known that the greater the porosity of a material, the greater the rate at which said material is degraded.

When the soil-mix material is exposed to air, the above-mentioned micro-porosity, which is four to five times greater than that of concrete, leads to phenomena of drying and of carbonation that degrade the mechanical characteristics of the material.

That phenomenon is extremely troublesome for retaining wall applications, since the material can become degraded very quickly.

In order to solve that problem, it might be envisaged to provide a web of reinforced concrete having a thickness of several tens of centimeters on the exposed surface in order to improve the mechanical characteristics of the wall. Specifically, that way it would make it possible to withstand forces applied against the untreated wall while preventing degradation of the mechanical characteristics of the material constituting the untreated wall.

A drawback of that technique is that it increases the thickness of a retaining work considerably, thereby leading to a loss of available space inside the work. For example, when the retaining work is in an underground car park, it can be understood that the volume available for making the car park would be significantly reduced by the large thickness of the walls, which is undesirable.

Document JP 2001 032235 describes a similar method in which a layer of concrete is applied to the uncovered surface in order to prevent erosion to the banks of a canal.

OBJECT AND SUMMARY OF THE INVENTION

An object of the invention is to propose a method of fabricating a retaining wall from an untreated wall obtained using a technique of digging ground and mixing it in situ with a binder, in which the retaining wall can be incorporated in a retaining work, in particular in an underground car park, without significantly increasing the thickness of the untreated wall.

The invention achieves its object by the fact that the method of the invention comprises:

- a step of making an untreated wall in ground, comprising a step of digging a trench in the ground and a step of simultaneously mixing the ground in situ with a binder; and
- a step of excavating a volume of ground adjacent to the untreated wall so as to uncover a surface of the untreated wall; the method being characterized in that it further comprises:
- a step of treating the untreated wall during which a protective treatment substance comprising a polymer substance is applied to said surface in such a manner as to obtain a retaining wall of thickness that is substantially equal to the thickness of the untreated wall.

Thus, by means of the invention, after performing the method, a retaining wall is obtained of thickness that differs little from the thickness of the untreated wall. In other words, unlike using a web of concrete, applying the protective treatment substance does not significantly modify the thickness of the wall. According to the invention, the protective treatment product is for treating and protecting the excavated surface (which is uncovered and exposed to air) of the untreated wall that is made using a soil-binder mixture, the binder preferably comprising a cement. That is to say, the protective treatment substance makes it possible to ensure that the soil-binder material retains its mechanical and physico-chemical properties, even when said material is exposed to air. Thus, by means of the invention, it is not necessary to have a thick web of concrete for the function specifically of mitigating any potential decrease in the mechanical properties of the untreated wall, it being understood that the protective treatment substance does not set out to withstand the mechanical forces to which the retaining wall is subjected.

The polymer substance is advantageously a resin, preferably an epoxy resin.

A program of laboratory testing has shown that the following families of substances, when used with soil-binder mixtures, present effectiveness that is much greater than expected.

- substances that cover and/or plug the soil-binder material: these substances are preferably applied as a thin layer (resin of polyamine or epoxy type).

It was not obvious, a priori, to use those substances since some of them combine with the lime of the cement, but soil-binder materials contain less lime than does concrete, and consequently the reactions have greater difficulty taking place, and they are less effective. Also, they are known for requiring application onto a surface that is smooth and hard in order to obtain good grip, whereas the surface of a wall made of soil-binder material is generally crumbly and a difficult to make plane.

By overcoming prejudices, the inventors have found with surprise that the above-mentioned substances are effective.

According to the invention, the thickness of the retaining wall is no greater than 105% of the thickness of the untreated wall.

Conventionally, the thickness of an untreated wall made using a technique of digging earth and mixing it simultaneously in situ with a binder (soil-mixing) lies in the range 400 millimeters (mm) to 1000 mm. If the untreated wall presents a thickness of about 500 mm, then the thickness of the retaining wall is no greater than 525 mm. Also preferably, the thickness of the retaining wall is preferably no greater than 103% of the thickness of the untreated wall, i.e. no greater than 515 mm.

In an advantageous variant, the step of making the untreated wall also includes a step of inserting at least one stiffener element into the trench, with this being done before the untreated wall solidifies. By way of example, this stiffener element is a metal bar that is inserted in the trench while the soil-binder mixture is still fresh. It enables the untreated wall to be stiffened and reinforced. Preferably, a plurality of stiffener elements are put into place, e.g. serving to fasten floors when the retaining wall constitutes the retaining work of an underground car park.

Once the untreated wall has solidified sufficiently, the excavation step is performed.

Advantageously, a step is also performed of planing the surface of the untreated wall before the treatment step. This planing step serves in particular to clean and to flatten the surface. It may also serve to uncover said at least one stiffener element locally or completely, if such an element is present.

The planing may be performed mechanically and/or hydraulically. It may be followed by a step of high-pressure washing.

Preferably, the surface is planed in its thickness, i.e. in a direction that is perpendicular to the surface, possibly in such a manner as to uncover said at least one stiffener element. Also preferably, planing is performed to a depth of about 10 mm.

It can be understood that the planing of the untreated wall has the effect of locally reducing its thickness. Consequently, if the treatment substance is of the penetrating type, it can be understood that the thickness of the retaining wall may be slightly less than the thickness of the untreated wall. It will nevertheless remain substantially equal to the thickness of the untreated wall. The same applies if the layer of treatment substance is thinner than the depth of the planing. In both of these situations, the thickness of the retaining wall is preferably not less than 95% of the thickness of the untreated wall. Preferably, the thickness of the retaining wall thus lies in the range 95% to 105% of the thickness of the untreated wall.

In a first implementation, at the end of the treatment step, an outer covering layer is obtained on the surface having a thickness that is much less than the thickness of the untreated wall, such that the thickness of the retaining wall remains substantially equal to the thickness of the untreated wall. In this implementation, the protective treatment substance is thus of the covering type. In particular, it may be a resin, e.g. of epoxy type, or an emulsion.

Preferably, the thickness of the covering layer is less than or equal to 10 mm.

For example, the protective treatment substance is a sprayable sealing diaphragm. In a second implementation of the invention, the protective treatment substance used is a substance that penetrates into the surface of the untreated wall. This penetrating substance serves to treat a shallow depth of the surface of the untreated wall without increasing its thickness. It can thus be understood that the thickness of the retaining wall remains approximately equal to the thickness of the untreated wall.

Advantageously, the protective treatment substance is applied by brushing or by spraying.

The invention also provides a retaining wall obtained by performing the method of the invention, said wall further including a stiffener element, and presenting a surface covered in a polymer substance, e.g. an epoxy resin.

The invention also provides a retaining work, in particular in an underground car park, and comprising a plurality of retaining walls of the invention.

BRIEF DESCRIPTION OF THE DRAWINGS

The invention can be better understood on reading the following description of implementations of the invention given as non-limiting examples, and with reference to the accompanying drawings, in which.

DETAILED DESCRIPTION OF THE INVENTION

Figure 1:
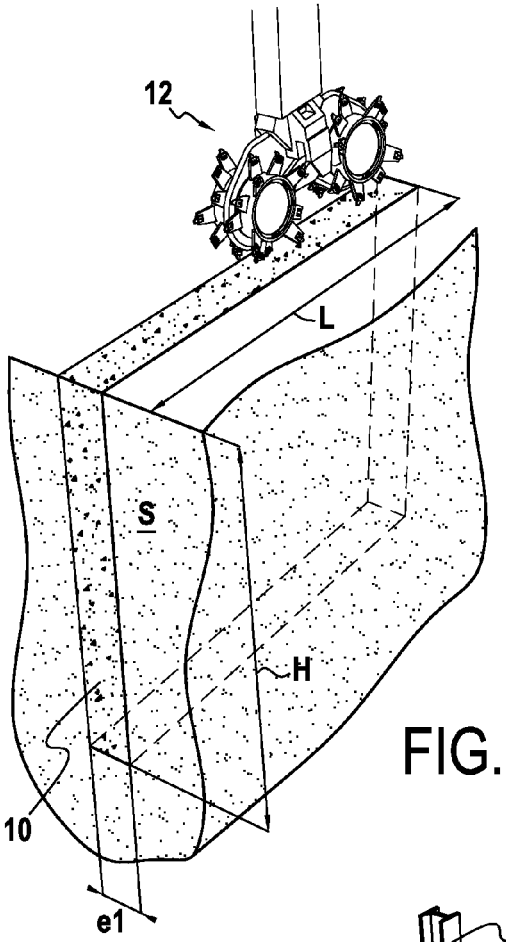
FIG. 1 shows the step of making the untreated wall in the ground by a technique of simultaneously digging the ground and mixing it in situ with a binder.
Figure 2:
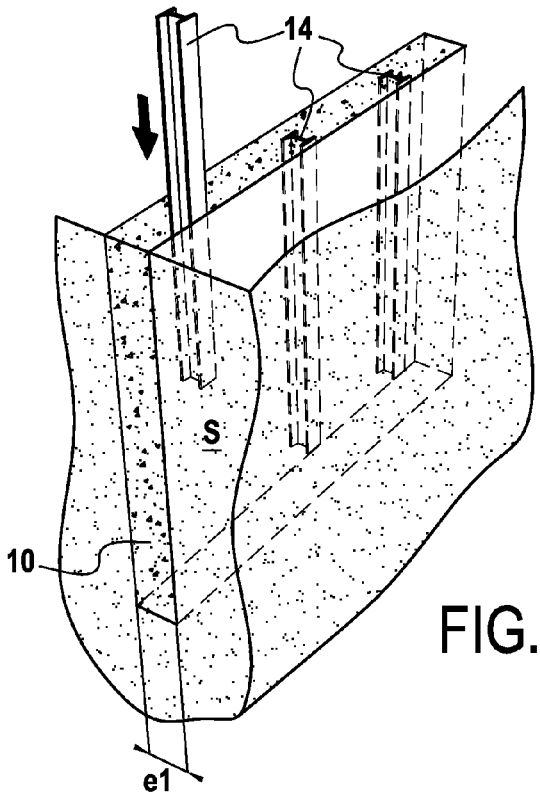
FIG. 2 shows stiffener elements being introduced into the untreated wall while the ground-binder mixture is still fresh.
Figure 3:
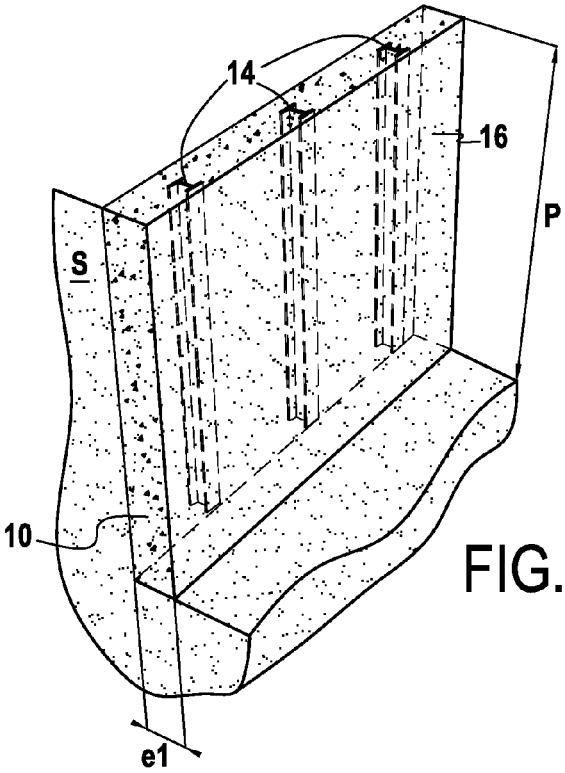
FIG. 3 shows the untreated wall and one of its surfaces exposed to air after the excavation step.

FIG. 1 shows the first step of the method of the invention for fabricating a retaining wall: initially making an untreated wall 10 in the ground S with the help of suitable tooling 12. As mentioned above, this untreated wall 10 is made using a soil-mixing technique, i.e. by digging the ground and simultaneously mixing it in situ with a binder injected into the trench. This untreated wall may be made using a method that is continuous or discontinuous. By way of example, it is possible to use the tooling described in document WO 2007/116178. In this example, the binder used is a cement. It is also possible to use a slurry, these types of binder being well known from elsewhere. The untreated wall 10, constituted by a ground-binder (ground-cement) material, may present a shape that is circular, prismatic, or any other shape.

As can be seen in FIG. 1, the untreated wall 10 presents a height H, a length L, and a thickness e1. In this example, the untreated wall 12 presents a thickness of about 500 mm and a height H of about 11 meters (m). At this stage, the untreated wall 10 is surrounded by ground S.

While the ground-binder material is still fresh, a step is performed of introducing a plurality of stiffener elements 14 into the trench. During this step, three metal bars are inserted vertically side-by-side, the length of the bars in this example corresponding approximately to the height H of the untreated wall 10. Inserting such stiffener elements need not be necessary, even though it is preferable in the presently-described example. The bars may be arranged at the edge of the trench on its excavation side, but that is not essential.

Once the untreated wall 10 has solidified sufficiently, an excavation step is performed, during which a volume of ground adjacent to the untreated wall 10 is removed so as to undercover a surface 16 of the untreated wall 10. In this example, the excavation step is performed to a vertical depth P that is less than the height of the untreated wall, e.g. over about 6 m.

Figure 4:
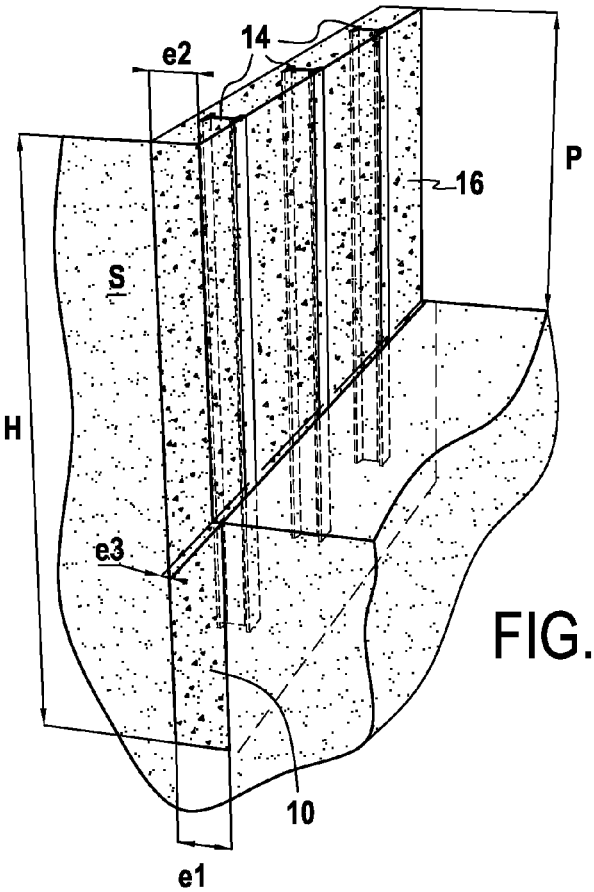
FIG. 4 shows the untreated wall of FIG. 3 after the planing step that serves to reveal the stiffener elements.
Figure 5:
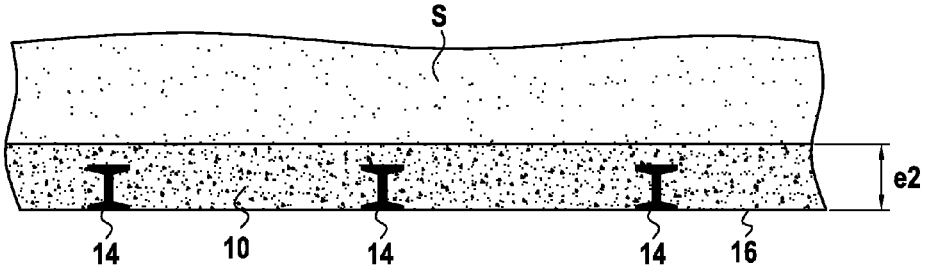
FIG. 5 is a plan view of the planed wall of FIG. 4.

Thereafter, a step is performed of mechanically planing the thickness of that surface so as to uncover the stiffener elements 14 and so as to remove the ground-binder material that was in contact with the surrounding terrain S. This produces a planed untreated wall of thickness e2, it being emphasized that the planing is performed over the entire area of the excavated surface. As can be seen in the example of FIGS. 4 and 5, the planing is preferably, but not necessarily performed until the metal bars 14 are reached. In this example, the surface is planed to a depth e3 of about 10 mm. The thickness e2 is thus equal to about 490 mm. After the planing step, it is preferable, but not essential, to perform a cleaning step, e.g. using a high-pressure jet.

Figure 6:
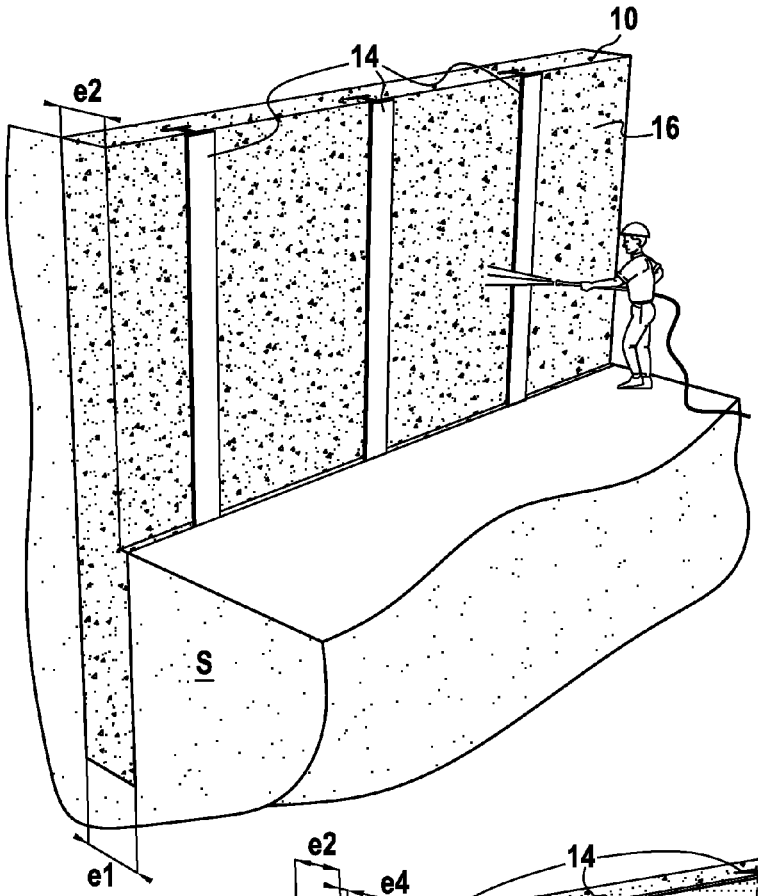
FIG. 6 shows the step of treating the surface of the planed wall.

In accordance with the invention, a step is then performed of treating the planed untreated wall 10, during which a protective treatment substance is applied to said surface 16. As can be seen in FIG. 6, the treatment step may be performed by spraying the protective treatment substance onto the surface 16. It may also be performed by brushing, when the treatment substance is a coating.

According to the invention, the protective treatment substance may either provide a thin-layer covering, or else it may impregnate the surface to be treated.

Figure 8:
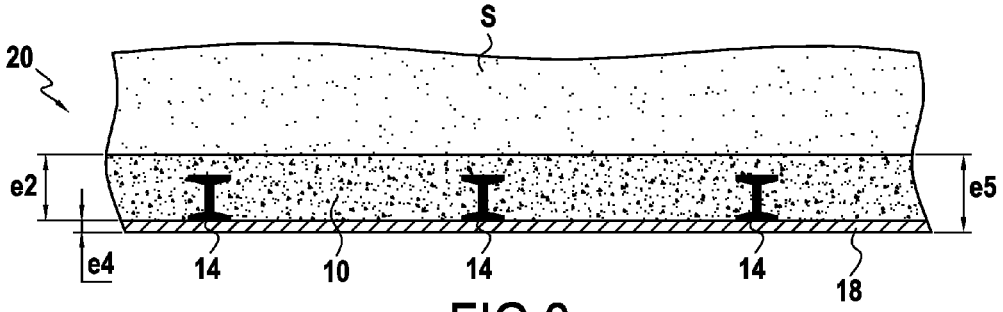
FIG. 8 is a plan view of the FIG. 7 retaining wall obtained by performing a first implementation of the invention, the treatment substance use being a covering substance.
Figure 7:
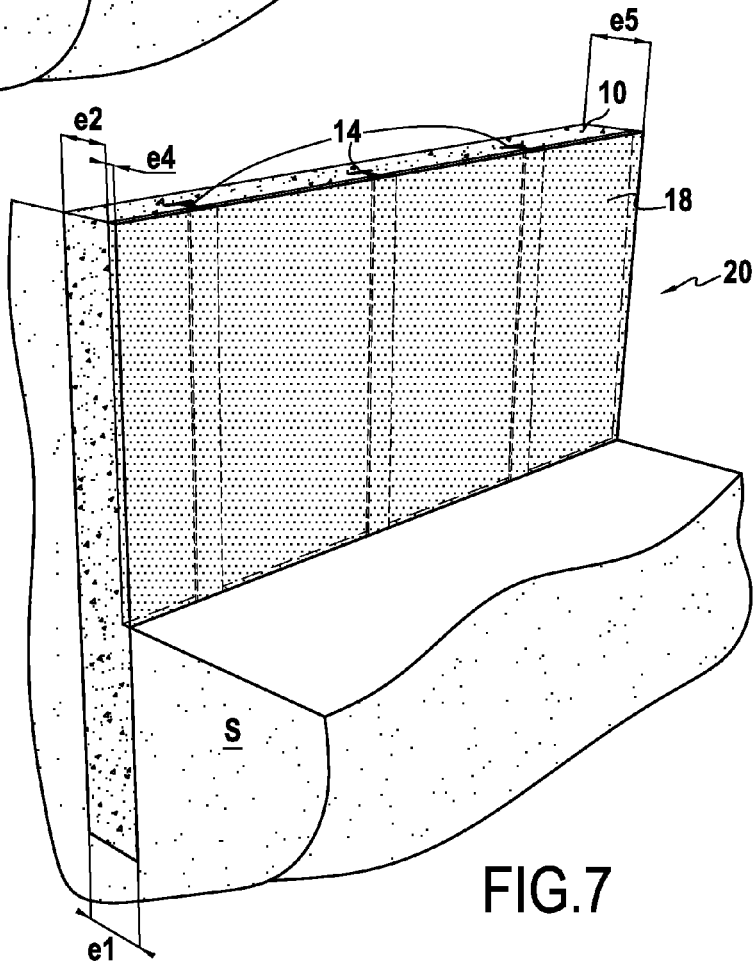
FIG. 7 shows the retaining wall obtained at the end of the treatment step.

In the first implementation of the method of the invention, shown diagrammatically in FIGS. 7 and 8, the protective treatment substance used is a covering substance, such that at the end of the treatment step of FIG. 6, an outer covering layer 18 is obtained on the surface 12 with a thickness e4 that is much less than the thickness e1 of the untreated wall 10. Specifically, the thickness e4 of the outer covering layer 18 is about 8 mm. At the end of the treatment step, a retaining wall 20 is thus obtained having thickness e5 that is about 498 mm. In other words, the thickness e5 of the retaining wall 20 as obtained in this way is substantially equal to the thickness e1 of the untreated wall 10.

As a protective treatment substance, use is made of a polymer substance, e.g. an epoxy resin. It is also possible to use other types of coating or other types of the resin, in particular those selected from the above-described substances.

Figure 9:
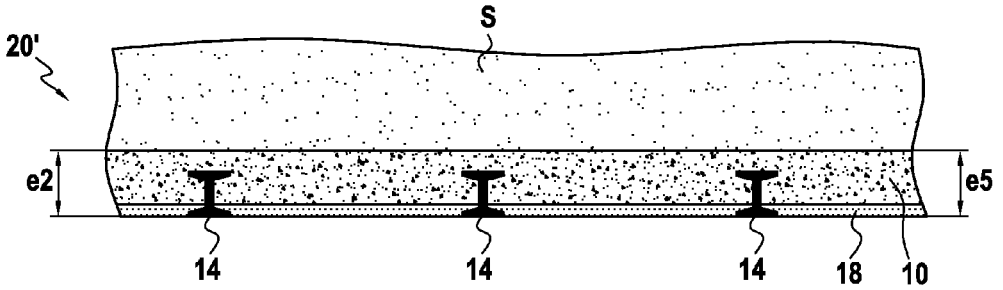
FIG. 9 is a plan view of the FIG. 7 retaining wall obtained by performing a second implementation of the invention, the treatment substance use being a penetrating substance.

In a second implementation of the method of the invention, as shown diagrammatically in FIG. 9, the protective treatment substance used is a penetrating substance that impregnates the surface 16 of the wall for treatment. In this example, the penetrating treatment substance is applied by brushing. Consequently, applying this penetrating treatment product increases the thickness e2 of the planed untreated wall very little, if at all. In this example, the thickness e2 of the retaining wall 20' as obtained in this way is about 490 mm, and thus a little less than the thickness e1 of the untreated wall 10. It follows that the thickness e2 of the retaining wall 20' lies in the range 95% to 105% of the thickness e1 of the untreated wall. Once again, in accordance with the invention, the thickness of the retaining wall 20' remains substantially equal to the thickness e1 of the untreated wall 10.

The invention claimed is:

1. A method of fabricating a retaining wall, the method comprising:

(1) forming an untreated wall in soil, the forming comprising:

(a) digging a trench in the ground while simultaneously mixing the in situ soil resulting from the digging with a binder to form the untreated wall; and then (b) once the untreated wall has solidified, excavating a volume of soil adjacent to the solidified untreated wall so as to uncover and expose to atmosphere a face of the solidified untreated wall; and then (2) treating the face of said solidified untreated wall by applying, on said face, a layer of protective treatment comprising a polymer substance, the layer having a thickness not exceeding 5 percent of the thickness of the untreated wall.

2. The method according to claim 1, wherein the step of forming the untreated wall includes inserting at least one stiffener element into the trench before the untreated wall solidifies.

3. The method according to claim 1, further comprising planing the face of the solidified untreated wall before the treating step.

4. The method according to claim 2, wherein the face is planed in its thickness so as to uncover said at least one stiffener element.

5. The method according to claim 4, wherein the stiffener element is a metal bar, and wherein the planing step is performed until the metal bar is uncovered.

6. The method according to claim 1, wherein at the end of the treating step, an outer covering layer is obtained on the face having a thickness that is no more than 3% of the thickness of the untreated wall.

7. The method according to claim 6, wherein the thickness of the covering layer is less than or equal to 10 mm.

8. The method according to claim 6, wherein the layer of protective treatment is a sprayable sealing diaphragm.

9. The method according to claim 1, wherein the layer of protective treatment is a substance that penetrates into the face of the solidified untreated wall.

10. The method according to claim 9, wherein the layer of protective treatment also includes a mineralizing substance.

11. The method according to claim 1, wherein the layer of protective treatment is applied by brushing or by spraying.

12. The method according to claim 1, wherein the polymer substance comprises a resin.

13. The method according to claim 12, wherein the resin is an epoxy resin.

14. A retaining wall obtained by performing the method according to claim 2, said wall including a stiffener element, and presenting a face covered with a polymer substance.

15. A retaining work in an underground car park, comprising a plurality of retaining walls according to claim 14.

16. A method of fabricating a retaining wall, the method comprising:

(1) forming an untreated wall in soil, the forming comprising:

(a) digging a trench in the ground while simultaneously mixing the in situ soil resulting from the digging with a binder to form the untreated wall; then (b) once the untreated wall has solidified, excavating a volume of soil adjacent to the solidified untreated wall so as to uncover and expose to atmosphere a face of the solidified untreated wall; and then (2) treating the whole face of said solidified untreated wall by applying, on said whole face, a layer of protective treatment comprising a polymer substance, the layer having a thickness not exceeding 5 percent of the thickness of the untreated wall.

* * * * *